US010358818B2

(12) United States Patent
Eckes

(10) Patent No.: US 10,358,818 B2
(45) Date of Patent: Jul. 23, 2019

(54) PARTITION WALL ELEMENT AND PARTITION WALL

(71) Applicant: NOVOMATIC AG, Gumpoldskirchen (AT)

(72) Inventor: Annika Eckes, Gumpoldskirchen (AT)

(73) Assignee: NOVOMATIC AG, Gumpoldkirchen (AT)

( * ) Notice: Subject to any disclaimer, the term of this patent is extended or adjusted under 35 U.S.C. 154(b) by 214 days.

(21) Appl. No.: 15/127,066

(22) PCT Filed: Mar. 13, 2015

(86) PCT No.: PCT/EP2015/055308
§ 371 (c)(1),
(2) Date: Sep. 19, 2016

(87) PCT Pub. No.: WO2015/140067
PCT Pub. Date: Sep. 24, 2015

(65) Prior Publication Data

US 2017/0114537 A1 Apr. 27, 2017

(30) Foreign Application Priority Data

Mar. 17, 2014 (DE) ..... 10 2014 103 646

(51) Int. Cl.
*E04B 2/74* (2006.01)
*G07F 17/32* (2006.01)
*H01R 25/16* (2006.01)

(52) U.S. Cl.
CPC ..... *E04B 2/7405* (2013.01); *G07F 17/3216* (2013.01); *H01R 25/162* (2013.01);
(Continued)

(58) Field of Classification Search
None
See application file for complete search history.

(56) References Cited

U.S. PATENT DOCUMENTS 4,043,626 A 8/1977 Propst et al.
4,795,355 A 1/1989 Dorn et al.
(Continued)

FOREIGN PATENT DOCUMENTS

CH 588608 6/1977
DE 3628672 5/1990
(Continued)

OTHER PUBLICATIONS

International Search Report for PCT/EP2015/055308, English translation attached to original, Both completed by the European Patent Office dated May 7, 2015, All together 7 Pages.

*Primary Examiner* — Jason T Yen
(74) *Attorney, Agent, or Firm* — Brooks Kushman P.C.

(57) ABSTRACT

A partition wall element having a plate-shaped stand base and a wall element extending at a right angle thereto. The wall element can be fastened non-positively and/or positively to the stand base so that the wall element stands with its end side on the stand base. Linear electric conductors for at least one electric circuit and/or data lines of a data bus extend over the length of the stand base, wherein the at least one electric circuit and the at least one data bus or the at least one data connection can be connected to at least one electric circuit and at least one data bus or a data connection of the wall element. A partition wall can be built up from such a partition wall element in a simple and flexible manner, on which partition wall electrical and/or data connections can be made available without interfering cables.

12 Claims, 7 Drawing Sheets

(52) U.S. Cl.
CPC ..... *E04B 2002/7483* (2013.01); *E04B 2002/7487* (2013.01); *E04B 2002/7488* (2013.01)

(56) References Cited

U.S. PATENT DOCUMENTS

| | | | | |
|---|---|---|---|---|
| 4,918,258 | A * | 4/1990 | Ayer | H02G 3/00 174/53 |
| 5,277,609 | A * | 1/1994 | Ondrejka | A47B 21/06 439/211 |
| 6,837,012 | B2 | 1/2005 | Scherrer et al. | |
| 7,891,147 | B2 | 2/2011 | Bruder | |
| 2003/0154673 | A1* | 8/2003 | MacGregor | A47B 83/001 52/239 |
| 2006/0046823 | A1* | 3/2006 | Kaminkow | G07F 17/32 463/16 |
| 2007/0130853 | A1* | 6/2007 | Kennedy | A47H 21/00 52/238.1 |
| 2012/0159869 | A1* | 6/2012 | Plikat | E04B 2/7405 52/36.5 |

FOREIGN PATENT DOCUMENTS

| | | |
|---|---|---|
| DE | 10019746 | 10/2001 |
| DE | 202006005039 | 7/2006 |
| DE | 202006013253 | 1/2008 |
| DE | 202012009814 | 11/2012 |
| EP | 0896104 | 2/1999 |
| EP | 1733653 | 12/2006 |
| FR | 2800405 | 5/2001 |
| WO | 0161120 | 8/2001 |

* cited by examiner

PARTITION WALL ELEMENT AND PARTITION WALL

CROSS-REFERENCE TO RELATED APPLICATION

This application is the U.S. national phase of PCT Application No. PCT/EP2015/055308 filed on Mar. 13, 2015, which claims priority to DE Patent Application No. 10 2014 103 646.8 filed on Mar. 17, 2014, the disclosures of which are incorporated in their entirety by reference herein.

TECHNICAL FIELD

The present invention relates to a partition wall element comprising a plate-shaped stand base and a wall element extending at right angles thereto. Furthermore, the present invention relates to a partition wall comprising a plurality of partition wall elements according to the invention.

PRIOR ART

Partition walls or partitions of the type referred to above are used indoors for example to separate specific regions from one another. The partition wall elements usually used to construct such a partition wall have a specific dimensioning, in particular a predefined height and width, and often stand in a freely movable manner on a floor; for example, feet of the partition wall elements are also provided with castors. Such partition wall elements are often not visually attractive and a multiplicity of individual partition wall elements have to be stocked for different heights and/or widths of partition walls. Usually, for separating a specific region, just one partition wall element is installed on both sides of said region.

The document U.S. Pat. No. 4,043,626 discloses a movable office unit which may be formed from free-standing partition wall elements. An energy conveying system consisting of conveying sections is provided for a power supply of the office unit respectively formed from the free-standing partition wall elements. The partition wall elements of the respective office unit are installed freely on the energy conveying system or on the respective conveying sections and are merely secured against transverse movements by a holding groove. With the system described in the document U.S. Pat. No. 4,043,626, although office units may be flexibly constructed and supplied with power, the partition wall elements are installed in a free-standing manner on the conveying sections of the energy conveying system and may thus for example easily tilt, etc. Furthermore, a flexible and simple power supply or linking to a data network of at least individual partition wall elements—if necessary for e.g. lighting purposes—is not possible.

SUMMARY OF THE INVENTION

Therefore, the invention is based on the object of providing a partition wall element of the type mentioned in the introduction which is diversely usable and simply and flexibly linkable to electricity and/or data networks and enables a modular and secure construction of a partition wall which consists of a plurality of partition wall elements.

According to the invention, the object is achieved by the features of the independent claims. The dependent claims present advantageous configurations of the invention.

A partition wall element comprises a plate-shaped stand base and a wall element extending at right angles thereto, which wall element is to be fixed to the stand base in a force-locking and/or positively locking manner in such a way that the wall element stands with its broad-side end side on the stand base. In this case, ideally at least two linear power conductors for at least one electrical circuit and/or in particular at least two data lines of a data bus or of a data connection extend over the length of the stand base, wherein the at least one electrical circuit and the at least one data bus are connectable to at least one electrical circuit and/or to at least one data bus of the wall element.

A partition wall comprises a plurality of partition wall elements which are connected to one another.

The main aspect of the proposed solution is that the partition wall element is diversely usable, and a partition wall consisting of such partition wall elements may be adapted or converted very flexibly and rapidly to local conditions existing in each case. Here the respective partition wall element or the partition wall has a link to a power supply and/or to a data network which may likewise be flexibly adapted and wherein electrical and/or electronic devices are installable at an arbitrary location—without exposed cables or cables routed on the partition wall. Furthermore, stand base and partition wall element are connected to one another securely by a force-locking/positively locking connection in the assembled state.

The wall element is preferably provided in different heights, for example between 500 mm and 2500 mm, preferably between 800 mm and 2200 mm, and particularly preferably between 1000 mm and 1900 mm. The width and the depth are dimensioned such that the wall element with the assigned stand base, whose width and depth substantially correspond to the wall element, remains standing individually, even without a floor anchoring. By way of example, the width of the stand base is between 250 mm and 650 mm. Preferably between 350 mm and 550 mm and particularly preferably 450 mm. The depth of the wall element, which, in the assembled state, either covers or terminates flush with the stand base in this orientation, preferably measures between 200 mm and 400 mm, preferably between 250 mm and 350 mm and particularly preferably 300 mm. The wall elements used may have the same width as the stand base or be dimensioned such that they are narrower, wherein in this case filling elements are arranged between two adjacent wall elements.

The partition wall may consist of a plurality of partition wall elements having wall elements of different heights, wherein the stand bases retaining the wall elements are screwable to the floor for secure fixing. The arrangement of the partition wall elements makes it possible to achieve a privacy shield for a region delimited by the partition wall, wherein the different heights of the wall elements enable the privacy shield to be adapted in conformity with requirements. On account of the modular construction, partition walls of different lengths may be produced by the juxtaposition of a plurality of partition wall elements, wherein the partition wall may subsequently be shortened or lengthened as necessary by the removal or addition of a partition wall element. On account of the relatively narrow wall elements, comparatively simple transport and assembly that is easy to carry out are also possible besides space-saving mounting.

With regard to the use of the partition wall assembled from the partition wall elements in a casino for producing a privacy shield between gaming machines, it should be noted that when a gaming machine is changed, a very flexible and rapidly realized conversion of the partition wall for adaptation to the local conditions and e.g. to the respectively applicable regulations is possible. Bearing-containing wall elements having a height adapted to the gaming machines are used here. If the structural depth or the installation location of a gaming machine changes, partition wall elements may be removed or added. In this regard, in Germany, for example, in the German gambling directive there is a stipulation that gaming machines with prize possibilities must be separated by a privacy screen with a depth of at least 0.80 m—measured from the front edge of the gaming machine—at the level of at least the upper edge of the gaming machine.

The linear power conductors which are provided in the respective stand base and jointly form a current and/or voltage supply for the respective electrical circuits may be for example exposed contact tracks or individual electrical conductors/cores (such as e.g. phase conductors, neutral conductors, etc.) of a cable. Contact tracks or ribbon cables, for example, may likewise be provided as data lines. This enables an installation of electrical and/or electronic devices at an arbitrary location without exposed cables. By way of example, the stand base may be provided with customary sockets for electrical power and/or data, that is to say in particular LAN or USB plug connections, in order to be able to connect the corresponding devices at an arbitrary location in the course of a partition wall to be constructed.

In one advantageous development it is provided that for the connection of the power conductors of the electrical circuit and/or of the data lines of the data bus of a stand base to the adjacent stand base there are arranged sockets, on the one hand, and jacks, on the other hand, for forming plug contacts and/or contact prongs, on the one hand, and contact springs, on the other hand, which are operatively connected upon the coupling of two adjacent stand bases. In this way, the power conductors and/or data lines may be guided in a very simple and flexible manner over the length of the partition wall to be set up.

Expediently, the stand base is assigned an interface for feeding in electrical energy and/or data. The interface is connected to the linear power conductors and/or the data lines in the stand base, but need not be provided in every stand base. It is also possible, in the course of the partition wall to be set up, to provide a stand base having corresponding interfaces and to provide the energy fed in and the data fed in via the power conductors and/or data lines of the interconnected stand bases. It goes without saying that a power supply unit for a specific voltage and/or a wireless interface, in particular W-LAN or Bluetooth, for feeding data into a stand base may also be provided. Furthermore, it is possible to arrange the interface on the wall element and to couple it to the stand base.

In one configuration, the interface of the partition wall element communicates with an interface of a gaming machine comprising a game sequence controller. The two interfaces may be connected to one another via a data cable or wirelessly. Energy may be supplied to connected electronic devices via lines or connections of the interfaces or separate lines.

In one configuration, the wall element is equipped with a display device and/or a lighting device, wherein the display device and/or the lighting device are/is connected to a voltage supply device and/or a data device either directly or via the stand base. The wall element may be equipped for example with a screen or LED lighting, wherein driving may be effected for example via external computers that are coupled via the stand base assigned to the respective wall element. The power supply may also preferably be performed via the stand base, such that disturbing cables may be completely dispensed with. The contacting may be effected for example by means of piercing contacts or other plug connections. It goes without saying that the electrical circuits laid in the stand bases may also be controllable, such that the energy supply may be switched for example by the central computer.

According to one development, the gaming machine, by means of its game sequence controller, communicates with the display device and/or the lighting device via the interfaces in order to change contents and/or representations. According to an alternative development, a data processing device installed on the stand base evaluates data of the gaming machine that are present at the interface of the partition wall element and communicates with the display device and/or the lighting device. The gaming machine may, on the one hand, actively influence the display device and/or the lighting device or, on the other hand, merely provide data at the interface which are readable and processable by the data processing device installed in the stand base. External storage devices and/or computers may also be connected to the interface of the data processing device installed in the stand base, for example via a network, in order for example to provide image data for the display device or data for the control of the lighting device.

In a further configuration, the display device and/or the lighting device are/is drivable depending on the game event. By way of example, when a prize is won or a special gain is attained or during a pay-out or a payment to the machine or a pause in the game or the like, the lighting device may be driven in a specific color, color sequence, a predefined luminous rhythm or the like or the display device may be driven for representing a specific image or the like. It is also possible to represent advertising representations of a free/occupied display or a text or an external content, for example a betting offer, by means of the display device, without departing from the invention.

In a further configuration, the wall element has a groove which is assigned to the stand base and in which is arranged at least one electrical contact element which connects the electrical circuit and/or the data bus of the stand base to the electrical circuit and/or the data bus of the wall element. By means of the groove, which extends across a corresponding web of the stand base, firstly the wall element is aligned relative to the stand base, and secondly the connection to the electrical circuit and/or the data bus is established during the assembly of the wall element on the stand base.

In an alternative configuration, the wall element has a web which is assigned to the stand base and which has at least one electrical contact element. Said at least one electrical contact element makes it possible to establish the electrical circuit and/or the data bus and/or the data connection of the stand base to the electrical circuit and/or the data connection of the wall element. By means of the web of the wall element, which engages into the groove of the stand base, firstly the wall element may be aligned relative to the stand base. Secondly, e.g. during the assembly of the wall element on the stand base, a link to an electricity network and/or to a data network is established very simply—via a link to the electrical circuit and/or the data bus and/or the data connection of the stand base.

Preferably, the wall element has a switching element which is coupled to an alarm device. By way of example, a call or bell button may be installed on the wall element and be connected via the power conductors and/or data lines to a control center and/or a display element fixed to the wall element, in order to call service personnel.

Preferably, the wall element has a body and/or at least one mount for a sheet and/or a shelf base and/or a table top. The screen or some other display device may be inserted between side walls, upper part and baseplate of the body. It is also possible, of course, to insert a whole-area filling element or shelf bases. The upper termination of the wall element may be formed by a table top or similar repository. In order to fix a separating sheet to the wall element, a mount for a sheet is fitted. The mount may fix the sheet in a clamping manner, for example, wherein the sheet may extend above or laterally with respect to the wall element or else in the interior thereof.

In order that a partition wall assembled from a plurality of partition wall elements arranged alongside one another is made visually attractive in conjunction with simple assembly, the wall element is provided with an insert groove for a sheet on a longitudinal outer wall. Between two adjacent partition wall elements a sheet is held securely in the corresponding insert grooves. The sheet may be fashioned from glass or plastic such that it is either transparent or opaque. The arrangement of a thin screen is also possible.

In order to reliably connect two stand bases to one another, the stand base has a tongue on one end side and a groove complementary to the tongue on the other end side.

Expediently, the groove and respectively the tongue are embodied in a dovetail-shaped or T-shaped fashion.

In order to produce an angular partition wall, the stand base is embodied such that it is beveled at least on one end side, or the stand base may be mitered.

It goes without saying that the features mentioned above and those yet to be explained below are usable not only in the combination respectively indicated, but also in other combinations. The scope of the invention is defined only by the claims.

The invention is explained in greater detail below on the basis of a plurality of exemplary embodiments with reference to the associated drawing.

BRIEF DESCRIPTION OF THE DRAWINGS

The invention is explained in greater detail below on the basis of a plurality of exemplary embodiments with reference to the associated drawing.

In the figures.

EMBODIMENT OF THE INVENTION

Figure 1:
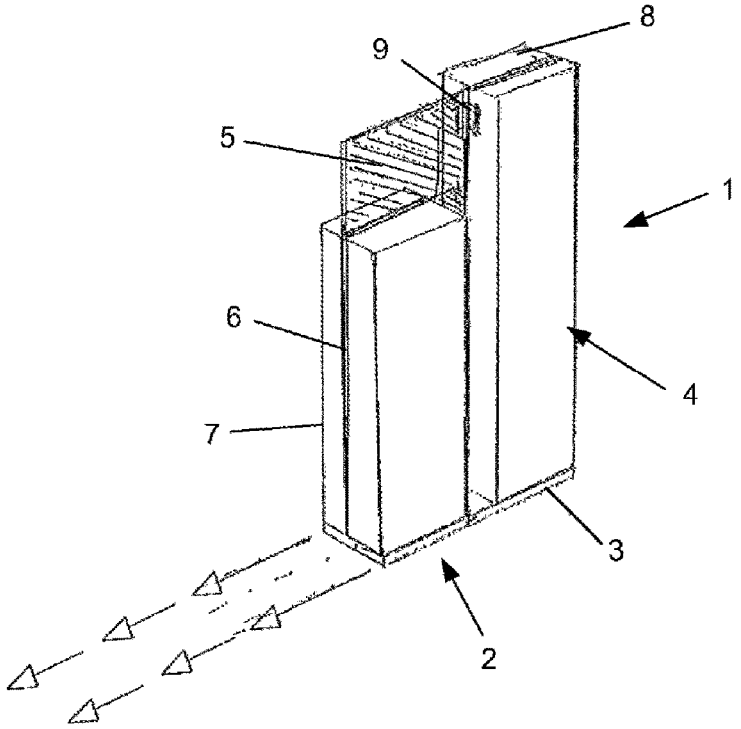
FIG. 1 shows a schematic illustration of a partition wall assembled from a plurality of partition wall elements in a first embodiment.
Figure 2:
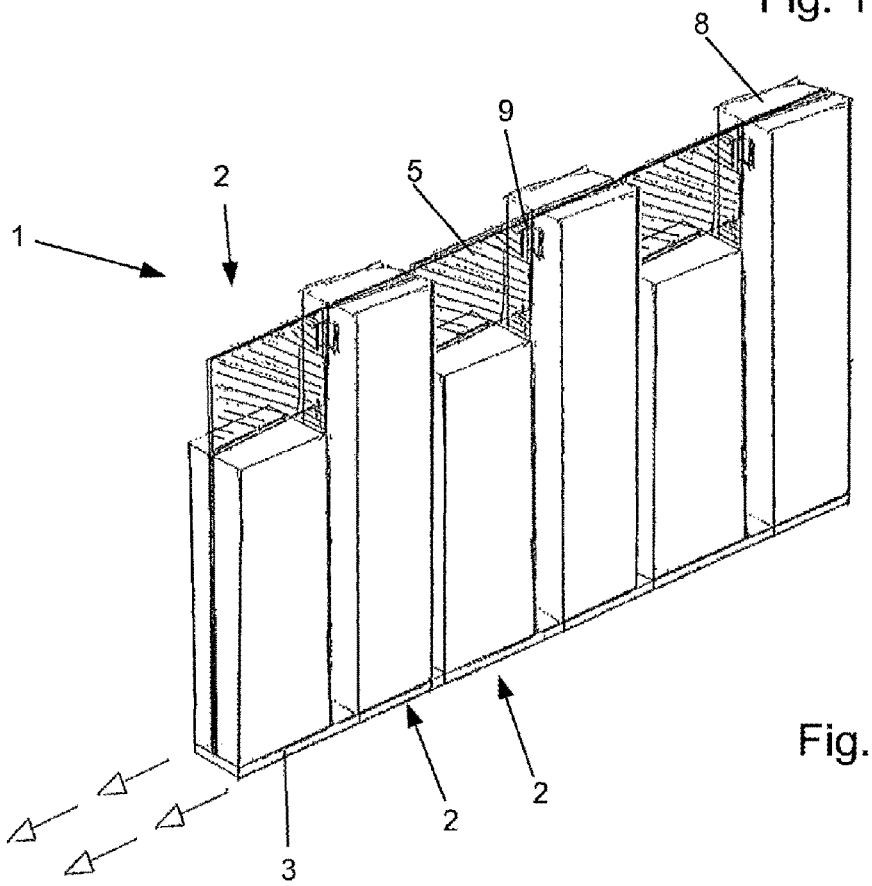
FIG. 2 shows a schematic illustration of the partition wall according to FIG. 1 in a second embodiment.
Figure 3:
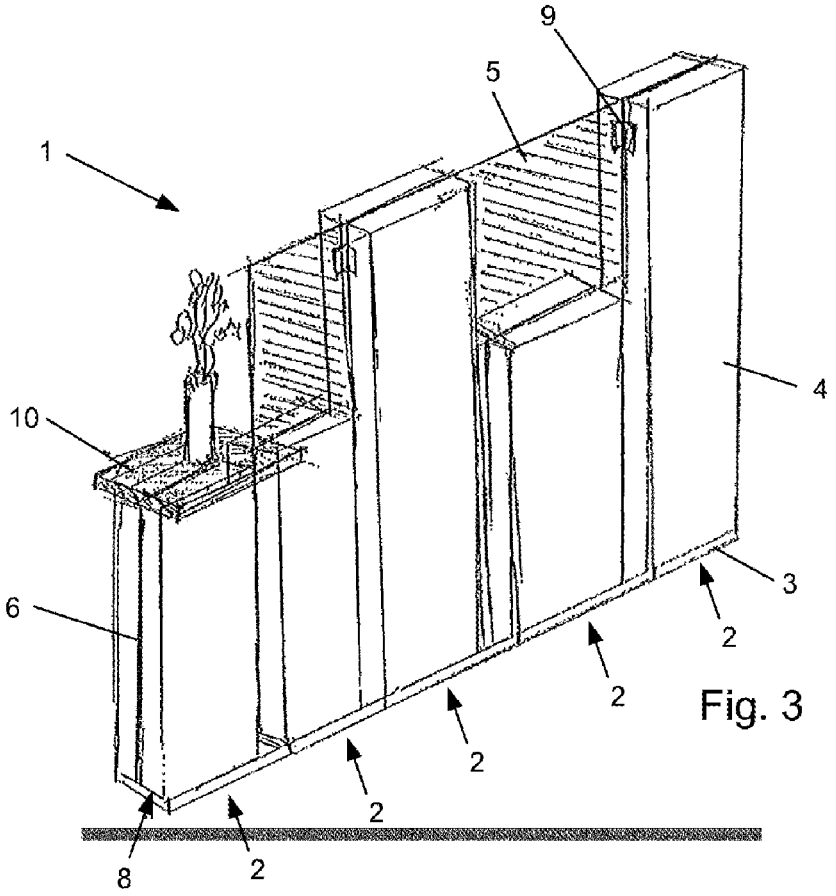
FIG. 3 shows a schematic illustration of the partition wall according to FIG. 1 in a third embodiment.

The partition wall 1 comprises a plurality of partition wall elements 2 arranged alongside one another, each of which substantially comprises a plate-shaped stand base 3 and a wall element 4 fixed thereon, wherein stand bases 3 arranged alongside one another mutually touch one another at the end sides and adjacent wall elements 4 are spaced apart from one another. A sheet 5, for example a tinted or frosted glass sheet, is in each case arranged between two adjacent wall elements 4, which are dimensioned with different heights according to the exemplary embodiments, said sheet being held in central insert grooves 6 in the longitudinal outer walls 7 of the wall elements 4 and having a height corresponding to the height of the lower one of the adjacent wall elements 4. In order likewise to arrange a sheet 5 on the lower one of the adjacent wall elements 4, the upper end side 8 of the wall element 4 is also provided with a central insert groove 6, wherein the insert grooves 6 extend over the entire width and/or height of the wall element 4. A mount 9, for example in the form of a clamping element, is provided for fixing the sheet 5 arranged at the end side. In order to provide a repository possibility for objects, a table top 10 is fixed on one of the wall elements 4, said table top having on the underside a web engaging into the insert groove 6 on the end side, in order that the table top is aligned relative to the wall element 4. The fixing of the table top 10 on the end side 8 of the wall element 4 may be effected by adhesive bonding or screwing, for example.

The wall elements 4 in accordance with FIGS. 1 to 4 may be embodied for example as parallelepipedal hollow bodies with different heights and the same width. The heights of the wall elements 4 are dimensioned such that a privacy shield is provided by the partition wall 1, in order to delimit regions on the known side and on the far side of the partition wall 4 from one another.

Figure 4:
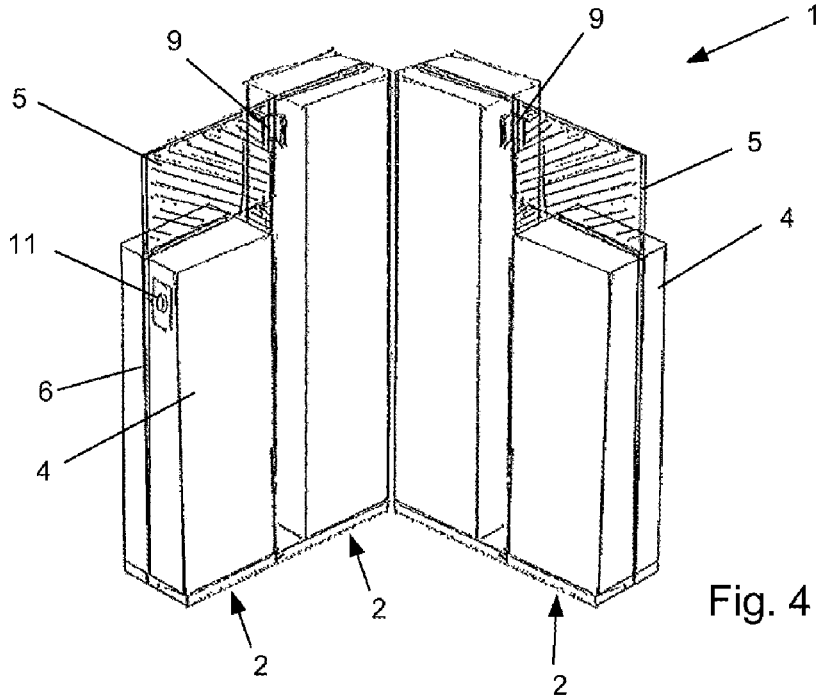
FIG. 4 shows a schematic illustration of the partition wall according to FIG. 1 in a fourth embodiment.
Figure 5:
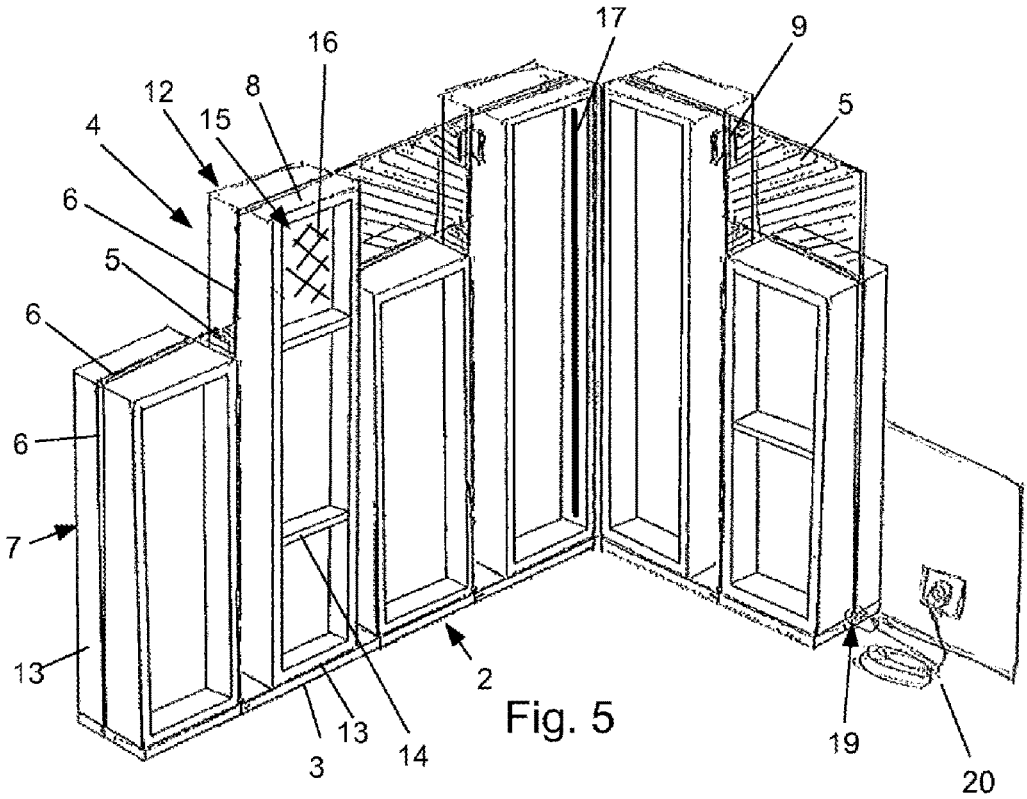
FIG. 5 shows a schematic illustration of the partition wall according to FIG. 1 in a fifth embodiment.
Figure 6:
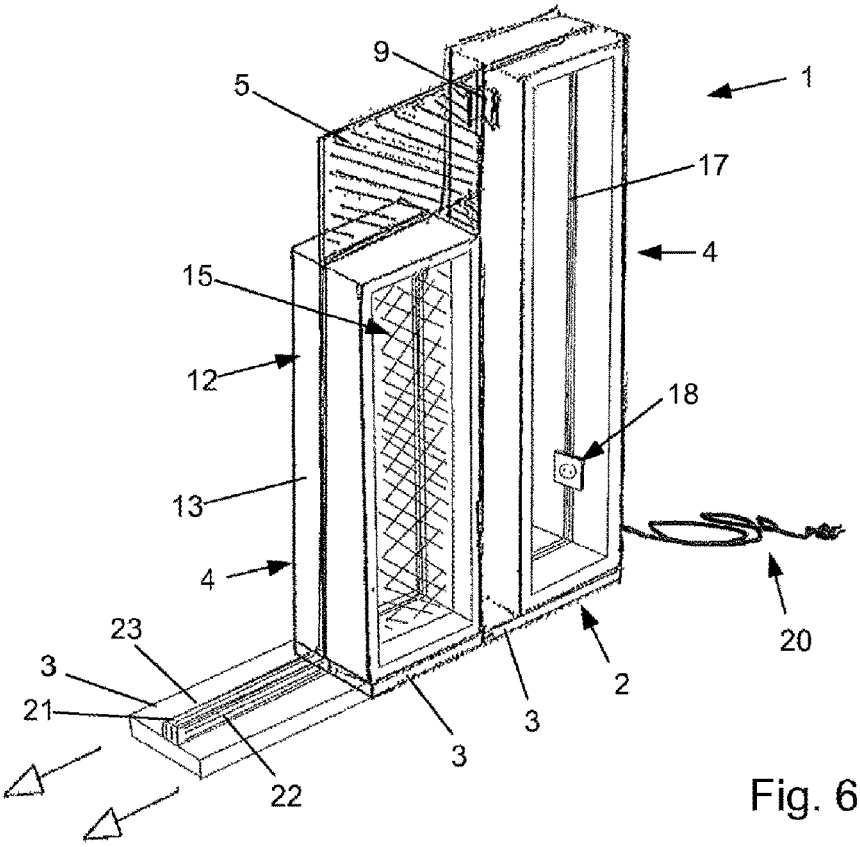
FIG. 6 shows a schematic illustration of the partition wall according to FIG. 1 in a sixth embodiment.
Figure 7:
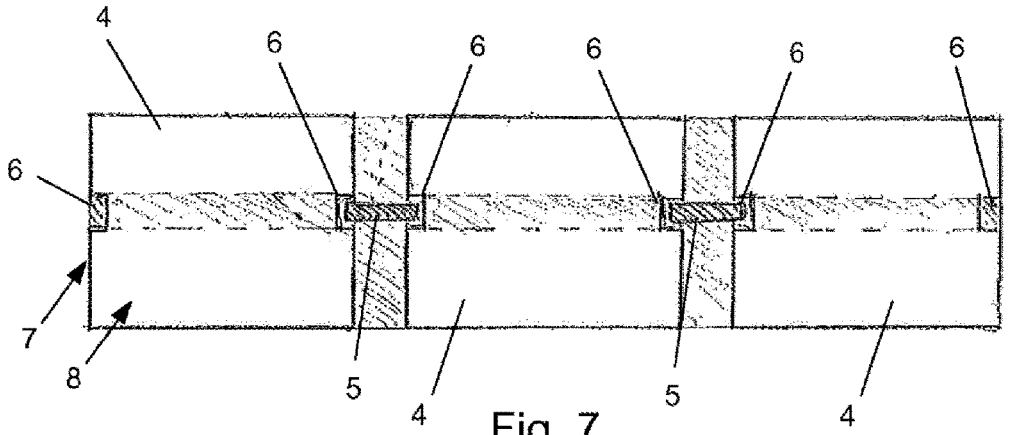
FIG. 7 shows a schematic plan view of the partition wall according to FIG. 1 in a seventh embodiment.
Figure 8:
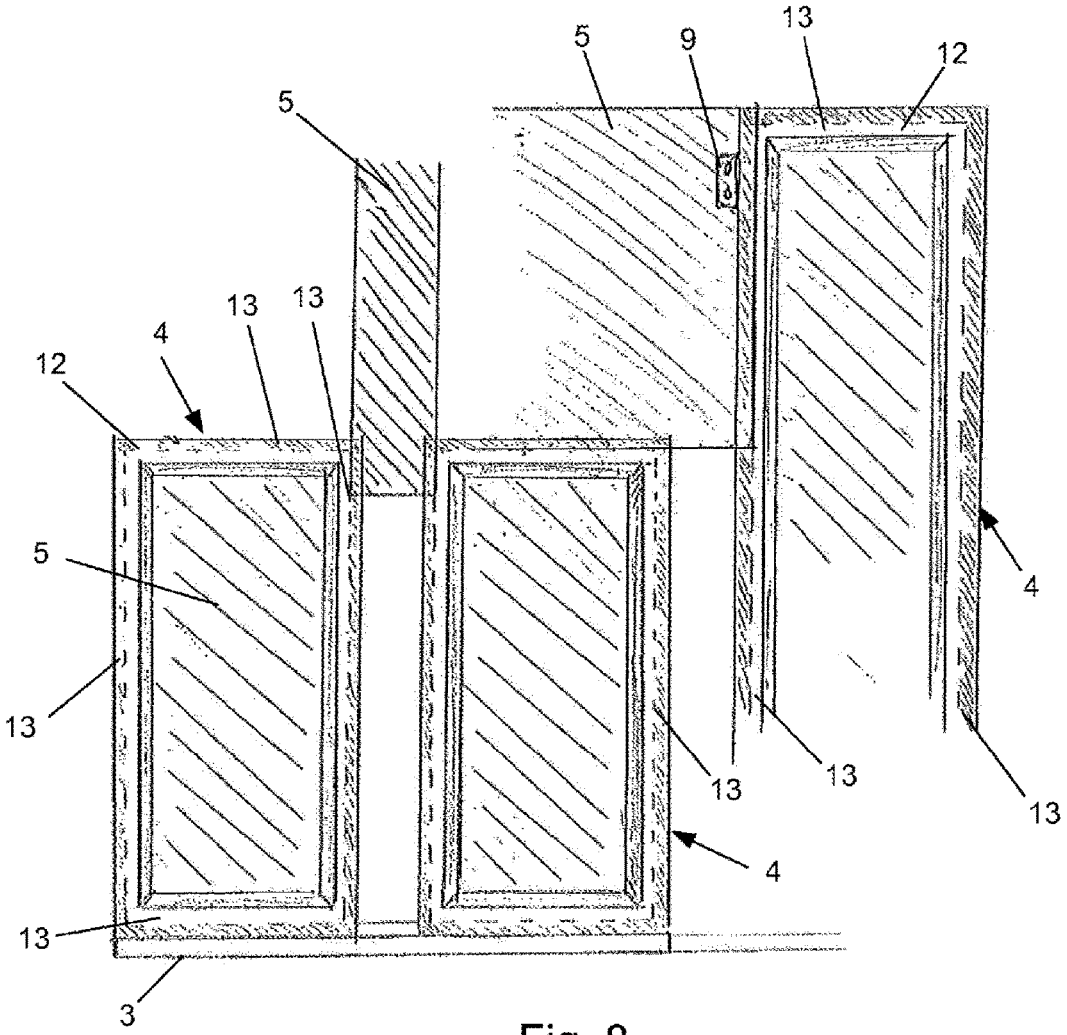
FIG. 8 shows a front view of the partition wall according to FIG. 7.
Figure 9:
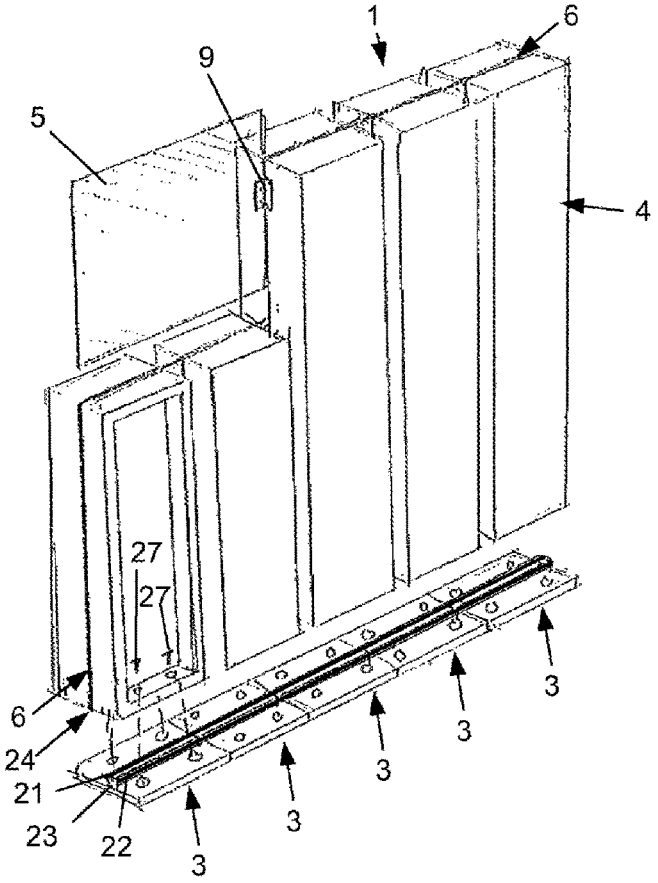
FIG. 9 shows a schematic exploded illustration of the partition wall according to FIG. 1 in an eighth embodiment.
Figure 10:
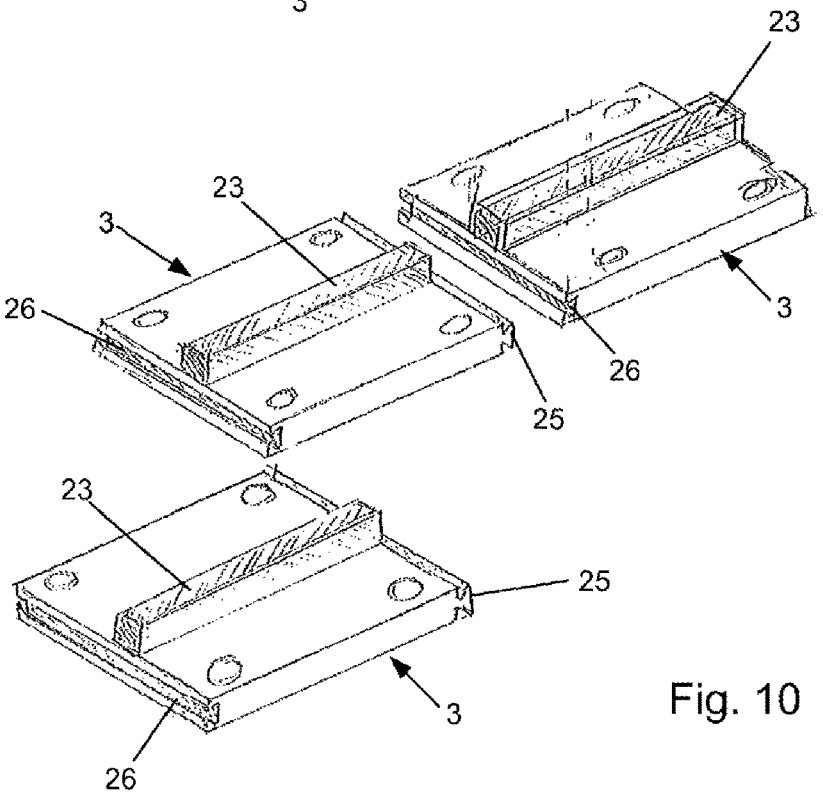
FIG. 10 shows an illustration of a plurality of stand bases of the partition wall according to FIG. 1.
Figure 11:
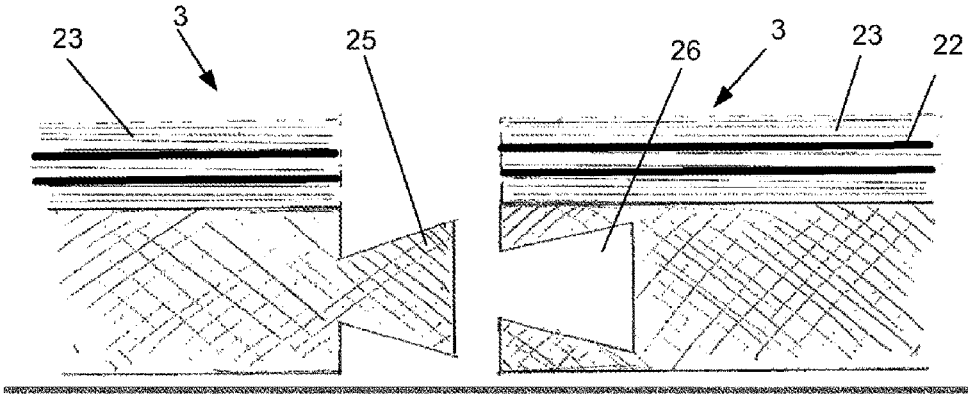
FIG. 11 shows an enlarged sectional illustration of two stand bases according to FIG. 10.
Figure 12:
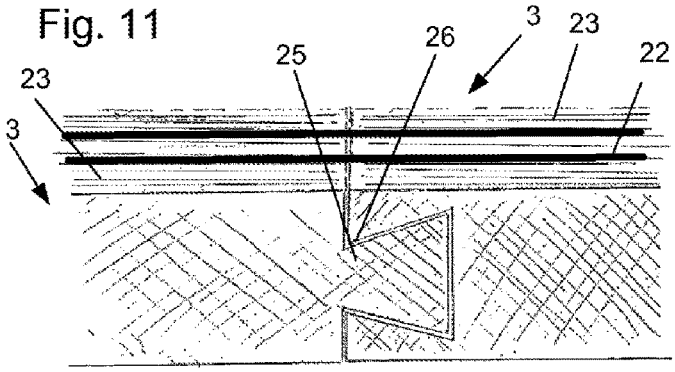
FIG. 12 shows an enlarged sectional illustration of the two interconnected stand bases according to FIG. 11.
Figure 13:
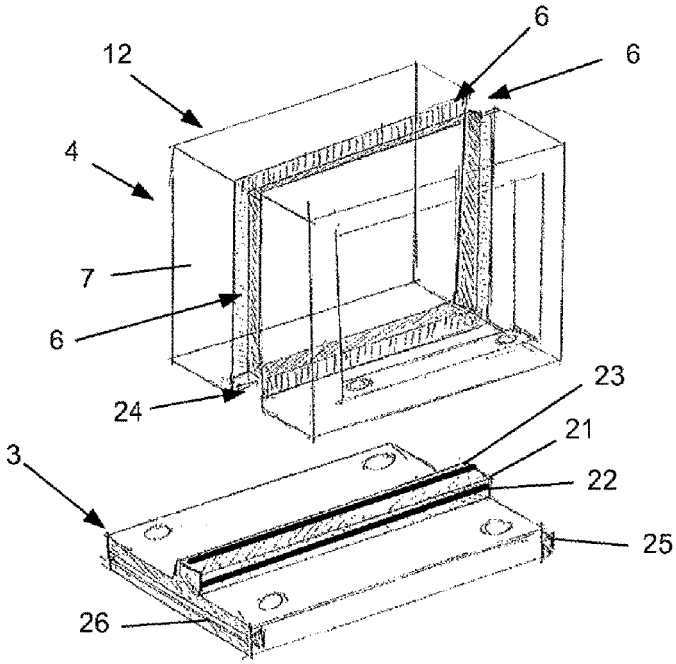
FIG. 13 shows a schematic exploded illustration of a partition wall element of the partition wall according to FIG. 9.

In order to provide an angular partition wall 1, as illustrated in FIGS. 4 and 5, either adjacent stand bases 3 and the wall elements 4 connected thereto may simply be assembled at the desired angle with respect to one another or the stand bases 3 are mitered at their corresponding end sides or embodied such that they are beveled at least on one end side.

In order to draw the attention of service personnel or the like or to trigger an alarm, a switching element 11 in the form of a bell button is installed in a wall element 4, said switching element being connected to a control center. The connection may be effected by a direct connection or via a coupling via the stand base 3, which coupling will be described below.

The wall element 4 may also be produced as a body 12 having longitudinal and end-side elements 13, wherein the body 12 may be subdivided into compartments by shelf bases 14. By way of example, a display device 15 in the form of a screen 16 or a light strip 17 may be integrated into the body 12. It goes without saying that a sheet 5 is also insertable into the body 12. The display device 15 and/or the light strip 17 may be connected to an electricity network and a data network, for example, via separate connections or via the coupling via the stand base 3, which coupling will be explained below. A plug connection 18 may also be fitted in or on the wall element, said plug connection serving for connecting further electrical and/or data-technological devices such as illuminants, additional screens and the like.

In order to provide power and data at the partition wall 1 without disturbing lines or cables, a stand base 3 preferably arranged at one end of the partition wall 1 is provided with an interface 19 for feeding in electrical energy and/or data. If appropriate, a power supply unit, a W-LAN or Bluetooth or USB interface may be arranged in the stand base. The interface 19 is connected firstly to a building-side electricity and/or data network, for example via cable connections 20, and secondly to linear power conductors 21 for at least one electrical circuit and data lines 22 of a data bus and/or a data connection, wherein the power conductors 21 and the data lines 22 extend over the entire length of the stand base 3. In this case, the power conductors 21 form the power supply for at least one electrical circuit in a wall element 4, such as e.g. the individual conductors or cores of a cable (e.g. phase conductors, neutral conductors, etc.). The data lines 22 as data bus or data connection provide for a link of the respective wall element 4 to a data network. The power conductors 21 and the data lines 22 are accommodated in a web 23, for example, which engages into an end-side groove 24 of the wall element 4. In this case, contact elements are accommodated in the groove 24, said contact elements ensuring a current conduction and/or a data connection from the stand base 3 into the assigned wall element 4 and the display device 15 and/or the light strip 17 installed there.

Alternatively, by way of example, the wall element 4 may have a web which may be introduced into an associated groove in the stand base 3. In this case, the power conductors 21 and the data lines 22 may be configured for example as exposed contact tracks fitted in the groove of the stand base 3 or as cables accommodated in a further groove provided specifically for the cable guidance. Corresponding contact elements may then be provided on the end-side web of the wall element 4, said contact elements ensuring current conduction and/or a data connection from the stand base 3 into the assigned wall element 4 and the display device 15 and/or the light strip 17 installed there.

For conductively connecting a stand base 3 to the adjacent stand base 3, at the end side plug contacts 25 are provided or the power conductors 21 and the data lines 22 are laid in the form of a ribbon cable that is inserted into the webs 23 of the stand bases 3. It is also possible to arrange at the end side contact springs and contact tongues which establish an electrically conductive contact upon a mechanical connection of two adjacent stand bases 3.

In order to connect the stand bases 3 to one another, a dovetail-shaped tongue 25 is provided on one end side and a dovetail-shaped groove 26 complementary to the tongue 25 is provided on the other end side.

For assembling the partition wall 1, firstly a first stand base 3 may be fixed on a support and further stand bases 3 are coupled in accordance with the required length of the partition wall 1 by means of the tongue-and-groove joints, wherein the mechanical connection is also accompanied by the electrical contacting or a corresponding cable is subsequently laid. Since the stand bases 3 are connected to one another, it is not necessary to anchor each stand base 3 in the support. Once the stand bases 3 have been assembled in conformity with the rules, the wall elements 4 with assigned plug elements or screw elements 27 are assembled in a predetermined position on the respectively assigned stand base 3, wherein the end-side groove 24 of the wall element 4 extends across the web 23 of the stand base 3. An electrical contacting may be effected in this case. Afterward, sheets 5 may be inserted into the longitudinal insert grooves 6 of the wall elements 4. If desired or necessary, an upper-side sheet 5 may also be assembled by means of mounts 9.

It is thus evident that changes and/or adaptations may be implemented relatively simply on account of the modular design of the partition wall 1. By way of example, wall elements 4 may be exchanged in order to arrange alongside one another wall elements 4 that are lower and/or higher to some extent, added in order to lengthen the partition wall 1, or removed in order to shorten the partition wall 1. In order that the partition wall 1 is immovable, the stand bases 3 are screwed to the support and the wall elements 4 are releasably connected to the stand bases 3 in a force-locking and/or positively locking manner, for example by means of plug and/or screw connections.

Figure 14:
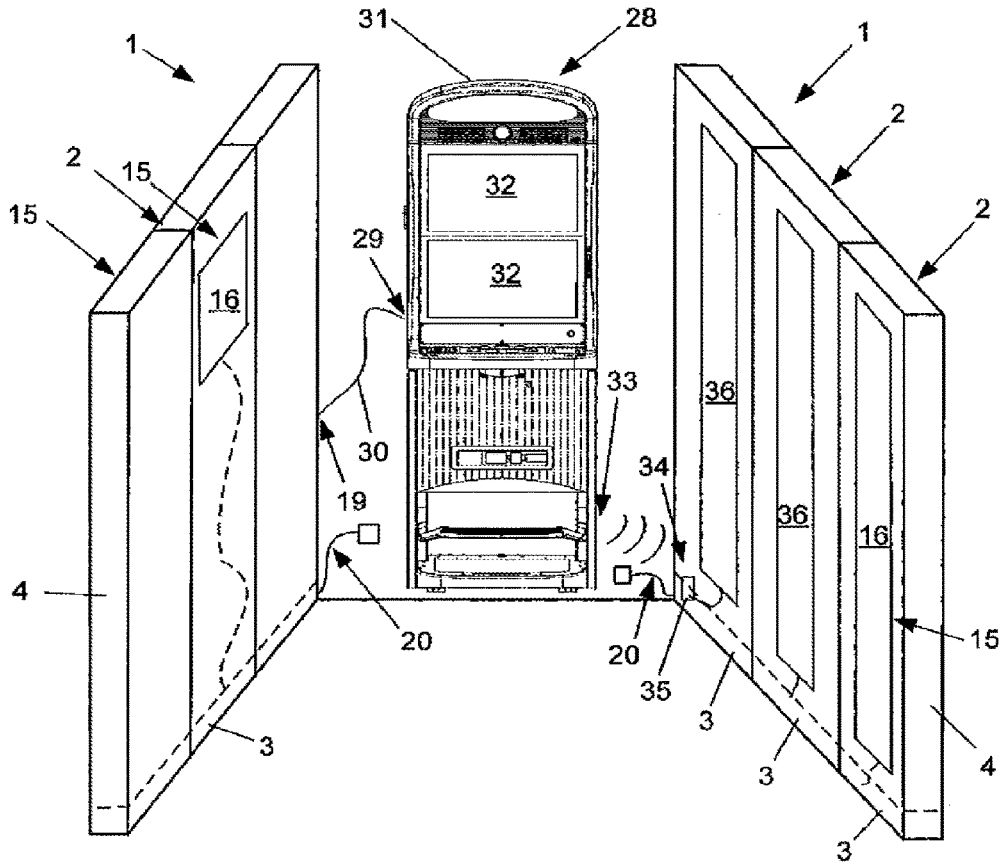
FIG. 14 shows a schematic illustration of a gaming machine with two assigned partition walls.

In accordance with the arrangement according to FIG. 14, a gaming machine 28 having a vertical housing 31 and two screens 32 accommodated therein is provided between two partition walls 1, wherein the free upper edges of the partition wall elements 2 which are directly adjacent to the gaming machine 28 have approximately the same height as the gaming machine 28. Via an interface 29 (not illustrated in more specific detail) the gaming machine 28 is coupled to the display device 15, which is embodied as a screen 16, either directly or via the interface 19 assigned to the partition wall 1, in order to drive the screen 16 by means of its game sequence controller or a further data processing device for the representation of images or to cause the corresponding image data to be displayed. The data-technological coupling of the gaming machine 28 to the display device 15 is effected by means of a data cable 30 that connects the interfaces 19, 29 on both sides to one another.

Furthermore, the gaming machine 28 may be provided with a wireless interface 33 for communication with a corresponding wireless interface 34 of the partition wall 1, which comprises a data processing device 35 that is coupled to the display devices 15 and/or to lighting devices 36 for example via the data lines 22 that are accommodated in the juxtaposed stand bases 3.

The display devices 15 and the lighting devices 36 of the partition walls 1 may be driven under game sequence control, in order in particular to display different contents, to generate different light colors or light sequences—such as e.g. flashing and/or moving light. If e.g. a prize is won on the gaming machine 28, animations may proceed on the display devices 15 and lighting devices 26, which animations are adjustable, preferably in a user- or environment-specific manner, if appropriate also on the gaming machine 28 or the data processing device 35 assigned to the partition wall 1. Programs having information regarding the individual animations may be stored in memory devices (not illustrated) assigned to the game sequence controller of the gaming machine 28 and/or the data processing device of the partition wall 1. The energy supply of the display devices 15 and lighting devices 36 accommodated in the partition walls 1 is effected via separate cable connections 20.

REFERENCE SIGNS

1. Partition wall
2. Partition wall elements
3. Stand base
4. Wall element
5. Sheet
6. Insert groove
7. Outer wall
8. End side
9. Mount -continued

| REFERENCE SIGNS |
| --- |
| 10. Table top |
| 11. Switching element |
| 12. Body |
| 13. Element |
| 14. Shelf base |
| 15. Display device |
| 16. Screen |
| 17. Light strip |
| 18. Plug connection |
| 19. Interface |
| 20. Cable connection |
| 21. Power conductor |
| 22. Data line |
| 23. Web |
| 24. Groove |
| 25. Tongue |
| 26. Groove |
| 27. Screw element |
| 28. Gaming machine |
| 29. Interface of 28 |
| 30. Data cable |
| 31. Vertical housing |
| 32. Screen |
| 33. Wireless interface of 28 |
| 34. Wireless interface of 1 |
| 35. Data processing device of 1 |
| 36. Lighting device |

The invention claimed is:

1. A partition wall element comprising;

a plate-shaped stand base; and a wall element extending at right angles to the stand base;

wherein the wall element is fixable to the stand base in a force-locking and/or positively locking manner in such a way that the wall element stands with its end side on the stand base, wherein linear power conductors for at least one electrical circuit and/or data lines of a data bus extend as exposed contact tracks or individual electrical conductors/cores of a cable over the length of the stand base;

wherein the at least one electrical circuit and/or the at least one data bus are connectable via a contact or piercing contact at an arbitrary location to at least one electrical circuit and/or to at least one data bus of the wall element, wherein the wall element has a groove which is assigned to the stand base and in which is arranged at least one electrical contact element which connects the electrical circuit and/or the data bus of the stand base to the electrical circuit and/or the data bus of the wall element, and wherein the wall element with assigned plug elements or screw elements is assembled in a predetermined position on the respectively assigned stand base, and wherein the groove of the wall element extends across a web of the stand base.

2. The partition wall element as claimed in claim 1, wherein for the connection of the power conductors of the electrical circuit and/or of the data lines of the data bus of a stand base to the adjacent stand base there are arranged sockets, on the one hand, and jacks, on the other hand, for forming plug contacts and/or contact prongs, on the one hand, and contact springs, on the other hand, which are operatively connected upon the coupling of two adjacent stand bases.

3. The partition wall element as claimed in claim 1, wherein the stand base is assigned an interface for feeding in electrical energy and/or data, said interface being connected to the linear power conductors and/or the data lines.

4. The partition wall element as claimed in claim 3, wherein the interface of the partition wall element communicates with an interface of a gaming machine comprising a game sequence controller.

5. The partition wall element as claimed in claim 1, wherein the wall element is equipped with a display device and/or a lighting device, wherein the display device and/or the lighting device are/is connected to a voltage supply device and/or a data device either directly or via the stand base.

6. The partition wall element as claimed in claim 3, wherein a gaming machine, by means of its game sequence controller, may communicate with a display device and/or the lighting device via the interface in order to change contents and/or representations.

7. The partition wall element as claimed in claim 3, wherein the data processing device installed on the stand base evaluates data from a gaming machine coupled to the interface of the partition wall element and communicates with a display device and/or the lighting device.

8. The partition wall element as claimed in claim 3, wherein a display device and/or the lighting device is drivable depending on a game event.

9. The partition wall element as claimed in claim 1, wherein the wall element has a switching element which is coupled to an alarm device.

10. The partition wall element as claimed in claim 1, wherein the stand base has a tongue on one end side and a groove complementary to the tongue on the other end side.

11. The partition wall element as claimed in claim 10, wherein the groove and respectively the tongue are embodied in a dovetail-shaped or T-shaped fashion.

12. The partition wall comprising a plurality of partition wall elements as claimed in claim 1 which are connected to one another.

* * * * *